US008401418B2

(12) United States Patent
Souda

(10) Patent No.: US 8,401,418 B2
(45) Date of Patent: Mar. 19, 2013

(54) IMAGE FORMING APPARATUS

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 472 days.

(21) Appl. No.: 12/725,705

(22) Filed: Mar. 17, 2010

(65) Prior Publication Data

US 2010/0239306 A1 Sep. 23, 2010

(30) Foreign Application Priority Data

Mar. 17, 2009 (JP) ..... 2009-064483

(51) Int. Cl.
*G03G 15/00* (2006.01)

(52) U.S. Cl. ..... 399/90; 399/112

(58) Field of Classification Search ..... 399/90, 399/111, 112
See application file for complete search history.

(56) References Cited

U.S. PATENT DOCUMENTS

| | | | | |
|---|---|---|---|---|
| 8,038,483 | B2 * | 10/2011 | Souda | 439/700 |
| 2003/0053819 | A1 | 3/2003 | Nomura et al. | |
| 2006/0291893 | A1 | 12/2006 | Yano | |
| 2007/0071482 | A1 | 3/2007 | Okabe | |
| 2007/0286632 | A1 * | 12/2007 | Okabe | 399/90 |
| 2008/0170875 | A1 * | 7/2008 | Kim et al. | 399/90 |
| 2008/0310881 | A1 | 12/2008 | Sato | |
| 2010/0329757 | A1 * | 12/2010 | Souda | 399/381 |

FOREIGN PATENT DOCUMENTS

| | | | |
|---|---|---|---|
| JP | S62-041132 | U | 3/1987 |
| JP | H09-319239 | A | 12/1997 |
| JP | H11-249362 | A | 9/1999 |
| JP | 2003-015378 | A | 1/2003 |
| JP | 2005-195632 | A | 7/2005 |
| JP | 2007-003925 | A | 1/2007 |
| JP | 2007-093830 | A | 4/2007 |
| JP | 2008-185825 | A | 8/2008 |

OTHER PUBLICATIONS

Japan Patent Office, Notification of Reason for Refusal for Japanese Patent Application No. 2009-064483 (counterpart to above-captioned patent application), dispatched Feb. 15, 2011.

* cited by examiner

*Primary Examiner* — Walter L Lindsay, Jr.
*Assistant Examiner* — Benjamin Schmitt
(74) *Attorney, Agent, or Firm* — Baker Botts L.L.P.

(57) ABSTRACT

An image forming apparatus including: a frame member including a first electrode and a replacement unit including a second electrode that electrically contacts the first electrode. The replacement unit is movable relative to the frame member along a moving direction. The moving direction includes a first direction and a second direction that intersects the first direction. The first electrode is formed by a wire and includes a contact portion. The contact portion, which is bent along an intersection plane, is movable in a third direction that is perpendicular to the first direction and the second direction. A direction of the contact portion is set so that the intersection plane intersects with a first plane and a second plane at angles smaller than an intersection angle formed by the intersection of the first plane and the second plane.

15 Claims, 8 Drawing Sheets

IMAGE FORMING APPARATUS

CROSS-REFERENCE TO RELATED APPLICATION

This application claims priority from Japanese Patent Application No. 2009-064483 filed on Mar. 17, 2009, the entire subject matter of which is incorporated herein by reference.

TECHNICAL FIELD

The present invention relates to an image forming apparatus.

BACKGROUND

There has been proposed a known image forming apparatus, the image forming apparatus includes a replacement unit that can be mounted to or dismounted from a frame member (a side plate of a main body of the known image forming apparatus). In one example disclosed, the replacement unit is a process unit including development cartridges, etc.

First electrodes are disposed on an inner side face of the frame member. Conversely, second electrodes are disposed on an outer side face of the replacement unit. The second electrode has a contact portion formed of a cup-shaped metal member (having a U-like shape in cross section) and a coil spring for biasing the contact portion against the outside (toward the frame member) of the replacement unit.

In this image forming apparatus, when the replacement unit is mounted to the frame member, the contact portions of the second electrodes are made to contact with the first electrodes, thereby being electrically connected. As a result, electric power can be supplied from the electric circuits of the main body to the replacement unit.

However, since the contact portion of the above-mentioned second electrode is formed of the cup-shaped metal member, it is difficult to reduce the production cost of the contact portion. For this reason, it has been considered to reduce the production cost by replacing the cup-shaped metal member of the contact portion with a contact portion formed of a metal wire bent into a shape along a plane.

SUMMARY

In the above-described known image forming apparatuses, the electrical connection between the frame member and the replacement unit is required to be established securely when the replacement unit is mounted again after having been dismounted or when the replacement unit is replaced.

However, the contact portion formed by a metal wire bent into a shape along a plane is low in strength in comparison with the cup-shaped metal member. For this reason, when the replacement unit is mounted or dismounted, the contact portions of the second electrodes create friction contact with the inner side face of the frame member and are apt to be damaged. As a result, a problem may occur in which the electrical connection between the first electrodes and the second electrodes, that is, the electrical connection between the frame member and the replacement unit, cannot be established securely.

In view of this, exemplary embodiments of the present invention may provide an image forming apparatus capable of securely establishing electrical connection between a frame member and a replacement unit while reducing production cost.

DETAILED DESCRIPTION OF EXEMPLARY EMBODIMENTS

General Overview

Figure 1:
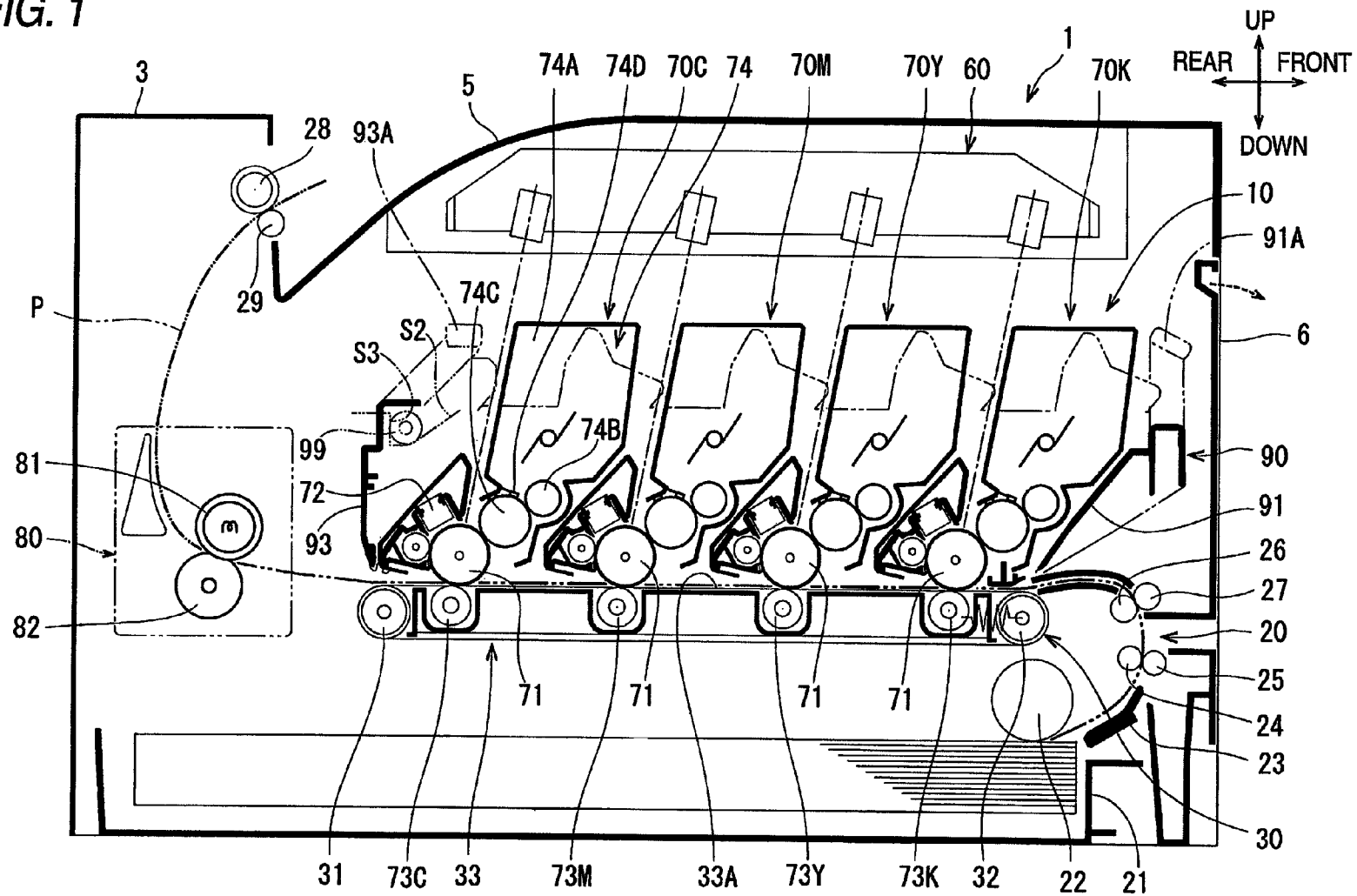
FIG. 1 is a schematic sectional view showing an image forming apparatus of an embodiment.

According to a first aspect of an exemplary embodiment of the invention, there is provided An image forming apparatus comprising: a frame member including a first electrode; a replacement unit including a second electrode that electrically contacts the first electrode, wherein the replacement unit is movable relative to the frame member along with a moving direction, the moving direction includes a first direction and a second direction that intersects the first direction, wherein one of the first electrode and the second electrode, which is formed by a wire, and which includes a contact portion that contacts the other of the first electrode and the second electrode, wherein the contact portion, which is bent along a intersection plane, and which is movable in a third direction that is perpendicular to a plane including both of the first direction and the second direction, and wherein a direction of contact portion is set so that the intersection plane of the contact portion intersects with a first plane and a second plane at angles smaller than an intersection angle formed by the intersection of the first plane and the second plane, and, wherein the first plane is parallel to both the first direction and the third direction, and the second plane is parallel to both the second direction and the third direction, and wherein the intersection angle between the first plane and the second plane is an acute angle.

According to an exemplary embodiment of the present invention, since the contact portion is formed of the metal wire bent into a shape along a contact plane, the production cost of the contact portion can be reduced in comparison with that of the contact portion formed of the cup-shaped metal member according to the related technology.

In addition, according to an exemplary embodiment of the present invention, the direction of the contact portion is set so that the intersection plane of the contact portion of one of the first electrode and the second electrode is parallel to the third direction and has a positional relationship in which the intersection plane intersects with the first plane and the second plane at angles smaller than the acute intersection angle formed by the intersection of the first plane, which is parallel to the first direction and the third direction, and the second plane, which is parallel to the second direction and the third direction. In other words, the direction of the contact portion is set so that the plane of the contact portion has a positional relationship in which the intersection plane is oriented in a direction in a range between the first and second directions, (i.e. the direction of the locus of the second electrode at the time of the mounting or dismounting of the replacement unit). Therefore, when the replacement unit is mounted or dismounted, the contact portion of one of the first electrode and the second electrode makes friction contact with the other of the first electrode and the second electrode at a shallow angle (in a state in which the misalignment between the direction of the contact portion of one of the first electrode and the second electrode and the direction of the other of the first electrode and the second electrode is small). Consequently, during the contact states between the contact portion of one of the first electrode and the second electrode and the other of the first electrode and the second electrode, the contact state in a direction of turning over the contact portion (in a direction opposite the intersection plane along the contact portion) and the contact state in a direction of twisting the contact portion can be relieved. Thus, breaking of the contact portion can be suppressed.

As a result, with the image forming apparatus according to this exemplary embodiment of the present invention, the electrical connection between the frame member and the replacement unit can be established securely while production cost is reduced.

Further, according to a second aspect of an exemplary embodiment of the invention, wherein the direction of the contact portion is set so that the intersection plane along the contact portion intersects with the first plane and the second plane at an angle equal to half the intersection angle between the first plane and the second plane.

Accordingly, the direction of the contact portion is set so that the intersection plane of the contact portion has a positional relationship in which the intersection plane is oriented in an intermediate direction between the first direction and the second direction. Consequently, during the contact states between the contact portion of one of the first electrode and the second electrode and the other of the first electrode and the second electrode, the contact state in a direction of turning over the contact portion (in a direction opposite the intersection plane along the contact portion) and the contact state in a direction of twisting the contact portion can be further relieved. Thus, breaking of the contact portion can be suppressed. Specifically, since the direction of the contact portion is set so that the intersection plane has a positional relationship in which the intersection plane is oriented in an intermediate direction between the first and second directions, the effects of the contacting between the contact portion of one of the first electrode and the second electrode and the other of the first electrode and the second electrode can be allocated almost evenly when the replacement unit is inserted in the first direction and in the second direction.

Further, according to a third aspect of an exemplary embodiment of the invention, wherein the first electrode and the second electrode are each respectively provided on a side face of the frame member and the replacement unit, the side faces being perpendicular to the third direction and opposing each other, wherein the contact portion protrudes from one of the side faces toward the other side face, and the protruded portion of the contact portion extends along a direction of the side face.

Accordingly, when the replacement unit is mounted or dismounted, the contact portion of one of the first electrode and the second electrode makes friction contact with the other of the first electrode and the second electrode in a direction parallel to the opposed faces of the frame member and the replacement unit. However, since the electrodes make friction contact with each other at a shallow angle as described above, the contact state in a direction of turning over the contact portion and the contact state in a direction of twisting the contact portion are relieved. Thus, breaking of the contact portion can be suppressed.

According to a fourth aspect of an exemplary embodiment of the invention, the image forming apparatus comprising: a frame member; a replacement unit, which is movable relative to the frame member; a first electrode provided on a side face of the frame member, the side face of the frame member being perpendicular to a third direction that is perpendicular to a plane including the first direction and the second direction; and a second electrode contacting the first electrode provided on a side face of the replacement unit, the side face of the replacement unit being perpendicular to the third direction and opposing the side face of the frame member, wherein one of the first electrode and the second electrode, which is formed by a wire, which has a portion that protrudes from the respective side face of either the frame member and the replacement unit, and wherein the protrude portion of the wire extends along a direction of the side face, and the direction of the extension intersects with the first direction and the second direction at angles smaller than a acute intersection angle formed between the intersection of the first direction and the second direction.

Accordingly thereto, when the replacement unit is mounted or dismounted, the contact portion of one of the first electrode and the second electrode makes friction contact with the other of the first electrode and the second electrode in a direction parallel to the opposed faces of the frame member and the replacement unit. However, since the electrodes make friction contact with each other at a shallow angle, the contact state in a direction of turning over the contact portion and the contact state in a direction of twisting the contact portion are relieved. The breaking of the contact portion can thus be suppressed.

According to a fifth aspect of an exemplary embodiment of the invention, wherein the wire is bent to form a contact portion formed from at least part of an ring-like shape extending along a plane, which is perpendicular to the side face, and wherein a part of the contact portion protrudes from the side face and extends along the direction of side face.

Accordingly, the metal wire is bent in order to form at least part of a ring-like shape and part of the ring-shaped part protrudes so as form the contact portion. Therefore, the production cost can be reduced.

According to a sixth aspect of consistent with an exemplary embodiment of the invention, wherein the wire includes a resilient portion, which is formed by bending the wire continuously, and which is connected to the contact portion, and wherein the resilient portion biases the contact portion against the other of the first electrode and the second electrode in a direction parallel to the third direction, wherein the resilient portion is a coil spring, and the contact portion is formed into a ring shape by bending the wire of the end portion of the coil spring in a direction parallel to the center axis line of the coil spring.

Accordingly, an electrode including both the contact portion and the resilient portion can be produced easily from a single wire. Therefore, the production cost can be reduced further.

According to a seventh aspect of consistent with an exemplary embodiment of the invention, wherein the first electrode includes the contact portion and the resilient portion.

Accordingly, by providing the first electrodes with the contact portion and the resilient portion on the frame member, the replacement unit can be made compact in comparison with a case in which a second electrode having a configuration similar to that of the first electrode is provided on the replacement unit. Furthermore, since there is a possibility that the replacement unit may be handled in a state of having been dismounted from the frame member, there is a high possibility that the exposed contact portions are damaged in the case that electrodes equipped with contact portions are used as the electrodes on the replacement unit. However, by providing the contact portions on the frame member, it is possible to reduce the risk of damaging the contact portions.

According to a eighth aspect of consistent with an exemplary embodiment of the invention, further comprising: an image forming section provided in the frame member, wherein the image forming section forms toner images on the surfaces of recording media; a drawer including a left side frame and a right side frame, wherein the left and right side frames support the image forming section on both sides in the width direction of the image forming section, and a conveying unit provided in the frame member, the conveying unit including a conveyor belt, which contacts with the back sides of the recording media to convey the recording media, and transfer rollers, which transfer the toner images to the recording media, wherein the replacement unit comprises the drawer, the image forming section disposed in the drawer, and the left and right side frames supported movably by the frame member in the first direction and the second direction, and wherein one of the first and second electrode is provided on one of the left and the right side frame and the other of the first and the second electrode is provided on an opposing side face of the frame member.

Accordingly, the drawer can be easily mounted to or dismounted from the frame member by moving both the left and right side frames thereof in the first direction and the second direction. Furthermore, the first and second electrodes for supplying electric power to the photosensitive members, the chargers, etc. of the image forming section are provided between the side frame of the drawer and the frame member. Moreover, the direction of the contact portion is set so that the intersection plane of the contact portion has a positional relationship in which the intersection plane is oriented in a range between the first and second directions (i.e. the direction of the locus of the second electrode at the time of the mounting or dismounting of the drawer). Consequently, the working effect of the present invention may be obtained securely between the drawer and the housing.

According to a ninth aspect of consistent with an exemplary embodiment of the invention, wherein the image forming section is a tandem type image forming section in which a plurality of toner cartridges, each corresponding to one of a plurality of colors are arranged in series along the conveying direction of the recording media, wherein the drawer includes a plurality of the second electrodes provided on the right and left side frames along the longitudinal direction thereof, and the frame member includes a plurality of the first electrodes provided at positions corresponding to the positions of the plurality of second electrodes.

Accordingly, a plurality of first and second electrodes are provided on the side frame of the drawer at predetermined intervals along the longitudinal direction thereof to supply electric power to a plurality of photosensitive members, chargers, etc. constituting the tandem type image forming section. Hence, in each electrode, the direction of the contact portion is set so that the intersection plane of the contact portion has a positional relationship in which the intersection plane is oriented in a range between the first and second directions (i.e. the direction of the locus of the second electrode at the time of the mounting or dismounting of the drawer). Consequently, the working effect of the present invention may be obtained more securely.

According to a tenth aspect of consistent with an exemplary embodiment of the invention, wherein the first electrode include the contact portion, and wherein the direction of the contact portions of at least one of a plurality of the first electrodes, which is provided on a upstream side of the first direction, is set so that the intersection plane along the contact portion intersects with the first plane and the second plane at angles smaller than the intersection angle between the first plane and the second plane.

Accordingly, when the replacement unit is inserted, the ranges in which the contact portions disposed on the upstream side of the first direction make contact with the replacement unit or the second electrodes are longer than the ranges in which the contact portions disposed on a side close to the downstream side of the first direction make contact with therewith. Thus, the effect of not adjusting the directions of the contact portions is apt to be experienced by the contact portions disposed on the upstream side. Consequently, with the above-mentioned configuration, the working effect of the present invention may be obtained by making only a minor change.

Exemplary Embodiments

An exemplary embodiment of the present invention will be described below with reference to the accompanying drawings.

As shown in FIG. 1, the printer 1 (an example of an image forming apparatus according to the embodiment) is a color laser printer for forming images having a plurality of colors on sheets (including OHP sheets, etc.) used as recording media by electro-photography. The right side of FIG. 1 is defined as the front side of the apparatus, and the left side of FIG. 1 is defined as the rear side of the apparatus. In addition, when the apparatus is viewed from the front side, the side on the left (the side near "FIG. 1") is defined as the left side of the apparatus, and the opposite side thereof is defined as the right side of the apparatus. Accordingly, the front and rear directions, the left and right directions and the up and down directions of the apparatus are shown. Furthermore, the front and rear directions, the left and right directions and the up and down directions shown in FIGS. 2 to 10 all respectively correspond to the directions shown in FIG. 1. Various components provided for the printer 1 will be described below with reference to FIG. 1.

1. General Configuration

Figure 3:
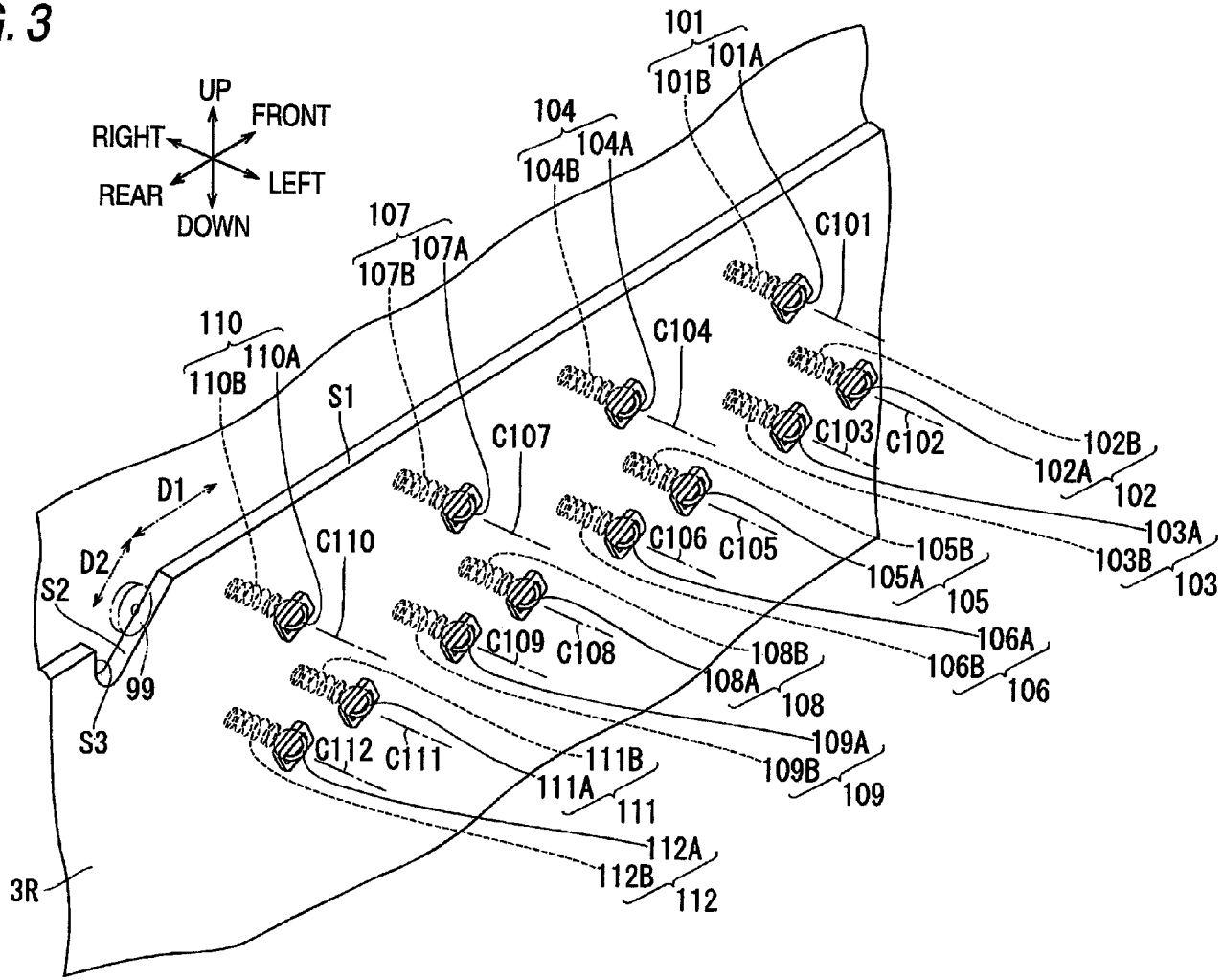
FIG. 3 is a perspective view showing a frame member according to the image forming apparatus of the embodiment.

The printer 1 comprises a housing 3, which is an approximately box-like member, and a frame member (only one side wall 3R of the frame member is shown in FIG. 3) is disposed inside the housing 3. A sheet feeding section 20, an image forming section 10, a conveying unit 30, and a fixing unit 80, etc. are installed in the frame member. The image forming section 10 is provided at a substantially central position of the housing 3.

A sheet discharge tray 5 is provided on the upper face side of the housing 3, and sheets on which images have been formed and which are discharged from discharge rollers 28, 29 are stacked on the sheet discharge tray 5. Furthermore, a front cover 6 is provided on the front face of the housing 3, and the front cover 6 can be opened and closed around the lower end of the front face of the housing 3, which serves as a swinging center axis.

2. Sheet Feeding Section

The sheet feeding section 20 has a sheet feed tray 21, a sheet feed roller 22 and a separation pad 23. The sheet feed tray 21 is removably accommodated in the lower part of the housing 3. A sheet feed roller 22 is provided above the front end portion of the sheet feed tray 21 to feed (convey) sheets stacked on the sheet feed tray 21 to the image forming section 10. The separation pad 23 separates a sheet of the stack of sheets, which is fed using the sheet feed roller 22, from the next adjacent sheet by offering predetermined conveying resistance to the sheet, etc.

Furthermore, conveying rollers 24 and 25 are provided in a portion veering toward the back side of the printer in a U-like shaped portion provided at the front side of a sheet conveying path P (indicated in a thick two-dot chain line in FIG. 1). The conveying rollers 24, 25 apply a conveying force to a sheet that is conveyed to the image forming section 10 while being bent in a U-like shape form.

Moreover, registration rollers 26 and 27 are provided downstream of the conveying rollers 24, 25 along the conveying path P. The registration rollers 26, 27 contact the leading end of a sheet conveyed by the conveying rollers 24, 25 to correct any skew of the sheet and then further convey the sheet to the image forming section 10.

3. Conveying Unit

The conveying unit 30 is disposed between the sheet feed tray 21 and the image forming section 10. The sheet feed tray 21 is provided in the lower part, and image forming section 10 is provided in the upper part. The conveying unit 30 has a conveyor belt 33 and transfer rollers 73K, 73Y, 73M and 73C, etc.

The conveyor belt 33 is wound between a drive roller 31 and a driven roller 32. The drive roller 31 is provided below the rear end side of the image forming section 10, the driven roller 32 is provided below the front end side of the image forming section 10. Furthermore, the drive roller 31 rotates in synchronization with the registration rollers 26, 27, etc. of the sheet feeding section 20. Accordingly, the conveyor belt 33 circulates between the drive roller 31 and the driven roller 32. The upper face of the conveyor belt 33 is disposed directly below the image forming section 10 in order to be substantially horizontal and to make contact with the back side of a sheet, thereby serving as a sheet conveying face 33A to convey the sheet along the conveying path P.

The transfer rollers 73K, 73Y, 73M and 73C are provided in the conveying unit 30 in a state of being in contact with the conveyor belt 33 from the back side of the sheet conveying face 33A. Since the conveyor belt 33 is made of conductive rubber, the conveyor belt 33 is charged with negative charges (a transfer voltage) to be applied to the respective transfer rollers 73K, 73Y, 73M and 73C. Thus, the conveyor belt 33 can convey sheets along the conveying path P while each sheet is attracted to the sheet conveying face 33A by an electrostatic force.

4. Image Forming Section

The image forming section 10 is a so-called direct tandem type, which performs color printing and the image forming section 10 has a plurality of, e.g. four, process cartridges 70K, 70Y, 70M and 70C, and a scanner section 60, etc. The scanner section 60 is disposed in the uppermost part within the housing 3. The four process cartridges 70K, 70Y, 70M and 70C correspond to four colors of toner (developer): black, yellow, magenta and cyan, respective, and are arranged in series from the upstream side to the downstream side of the sheet conveying face 33A. The process cartridges 70K to 70C are installed in a drawer 90 described later.

4.1 Scanner Section

The scanner section 60 has a laser light source, a polygon mirror, an fθ lens, and a reflection mirror, etc. The laser beam emitted from the laser light source is deflected by the polygon mirror and passes through the fθ lens. Then, the light path of the laser beam is reflected back by the reflection mirror and further reflected downward by the reflection mirror. As a result, the laser beam is irradiated onto the surface of a photosensitive drum 71 installed in each of the process cartridges 70K to 70C, thereby forming an electrostatic latent image.

4.2 Process Cartridges

The process cartridges 70K to 70C are different only in the color of toner serving as a coloring agent but the same in other respects. Hence, the process cartridge 70C is taken as an example and the structure thereof will be described below.

The process cartridge 70C includes a photosensitive drum 71, a charger 72, and a toner cartridge 74, etc., the characteristics of these being known.

The toner cartridge 74 has a toner storage chamber 74A in which toner is stored, a feed roller 74B, and a development roller 74C, etc. Furthermore, the toner inside the toner storage chamber 74A is fed to the development roller 74C by the rotation of the feed roller 74B and held on the surface of the development roller 74C. After the thickness of the toner is adjusted to a predetermined value using a layer thickness regulating blade 74D, the toner is fed to the surface of the photosensitive drum 71. The photosensitive drum 71 is disposed on the opposite side of the transfer roller 73C with the sheet conveying face 33A of the conveyor belt 33 held therebetween.

5. Fixing Unit

The fixing unit 80 is disposed on the downstream side of the sheet conveying path P from the process cartridges 70K to 70C. The fixing unit 80 has a heating roller 81 and a pressure roller 82. The heating roller 81 is disposed on the image forming face side of a sheet. The heating roller 81 is rotated in synchronization with the conveyor belt 33, etc. and applies a conveying force to the sheet while heating the toner transferred to the sheet. Conversely, the pressure roller 82 is disposed on the opposite side of the heating roller 81 with the sheet held therebetween, and the pressure roller 82 is driven and rotated while pressing the sheet against the heating roller 81. As a result, the fixing unit 80 heats and melts the toner transferred to the sheet and fixes the toner on the sheet and then conveys the sheet to the downstream side of the sheet conveying path P. The conveying path P is curved upward into a U-like shape along the conveying path downstream of the fixing unit 80. In addition, the discharge rollers 28, 29 are provided immediately ahead of the discharge tray 5 on the most downstream side of the sheet conveying path P, and the discharge rollers 28, 29 discharge sheets on which images have been formed to the discharge tray 5

6. General Description of Image Forming Operation

In the printer 1 according to an embodiment configured as described above, an image is formed on a sheet as described below. That is, when an image forming operation is started, the sheet feeding section 20 and the conveying unit 30 are operated, and the sheet is conveyed to the image forming section 10. Further, the scanner section 60, and the process cartridges 70K to 70C, etc. are operated. Hence, the surface of the rotating photosensitive drum 71 is uniformly charged positively by the charger 72 and then exposed to the laser beam irradiated from the scanner section 60. As a result, an electrostatic latent image corresponding to image forming data is held on the surface of the photosensitive drum 71.

Next, when the toner, which is held on the development roller 74C and which is positive charged positively, becomes opposite to and in contact with the photosensitive drum 71 by the rotation of the development roller 74C, the toner is supplied to the electrostatic latent image formed on the surface of the photosensitive drum 71. As a result, the electrostatic latent image on the photosensitive drum 71 is rendered visible, and a toner image formed by reversal development is held on the surface of the photosensitive drum 71.

Next, the toner image held on the surface of the photosensitive drum 71 is transferred to the sheet using a transfer voltage applied to the transfer rollers 73K to 73C. Then, after the sheet to which the toner image has been transferred is conveyed to the fixing unit 80, the toner is heated and pressed using the heating roller 81 and the pressure roller 82. Accordingly, the toner image is fixed onto the sheet. Finally, the sheet on which the image has been formed is discharged to the discharge tray 5, and the image forming operation is completed.

7. Drawer Mounting Operation and Dismounting Operation

Figure 2:
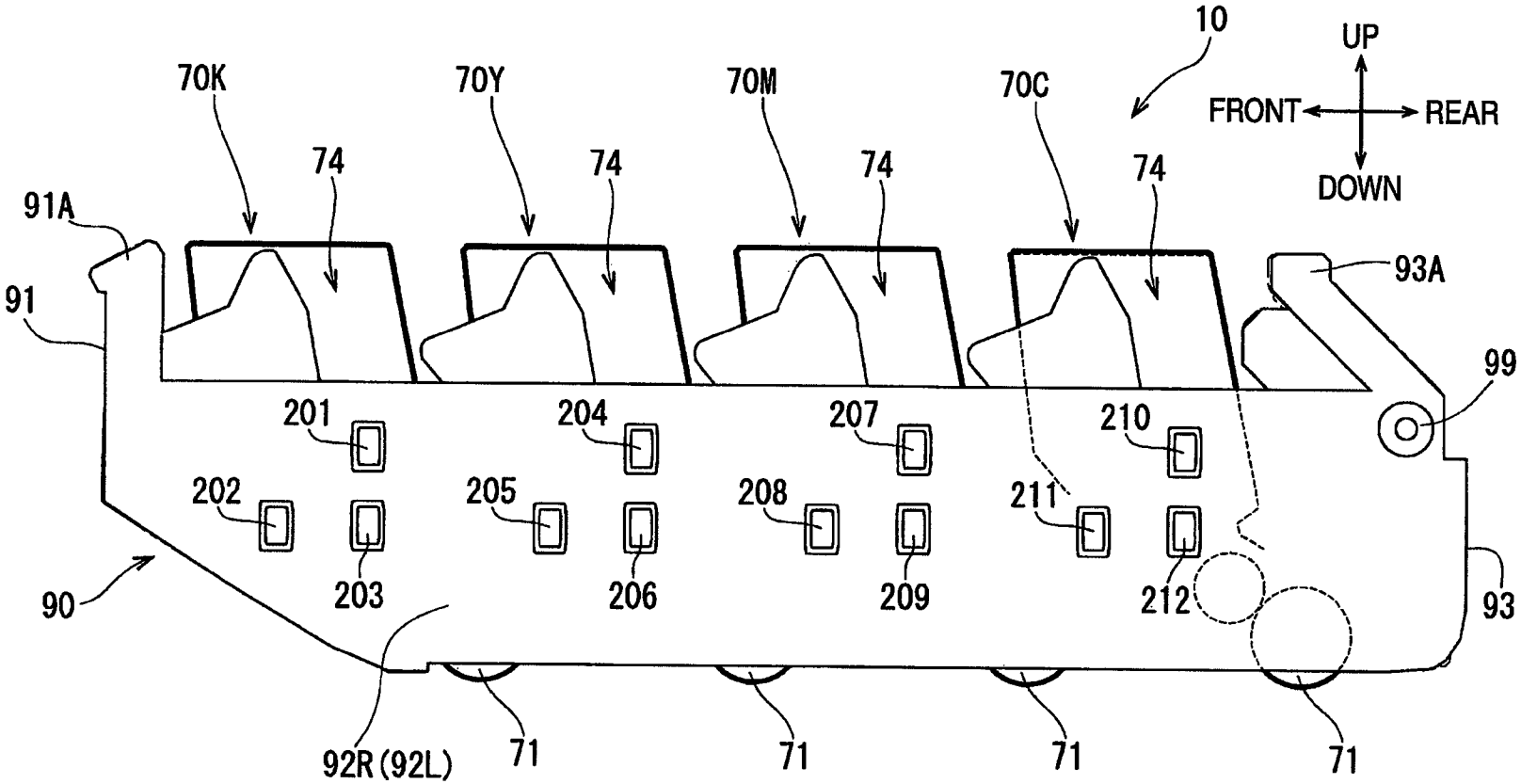
FIG. 2 is a right side view showing a drawer according to the image forming apparatus of the embodiment.

As shown in FIGS. 1 and 2, the image forming section 10 (except for the scanner section 60) is installed in the drawer 90 described below in detail. The drawer 90 is accommodated inside the housing 3 to be mountable and dismountable when accommodating and holding the image forming section 10. The drawer 90 as a single unit has a structure in which a front wall 91, a right side frame 92R (shown in FIG. 2), a left side frame 92L and a rear wall 93 are combined to form a frame shape (the shape of the left side frame 92L is a mirror image of the right side frame 92R shown in FIG. 2, and the left side frame 92L is provided on the far side of FIG. 2, while the right side frame 92R is provided on the near side of FIG. 2). The upper and lower portions of the drawer are open.

A handle 91A (on the front side) and a handle 93A (on the rear side) protrude upward from the upper end fringes of the front wall 91 and the rear wall 93, respectively. The user holds the handles 91A and 93A when mounting or dismounting the drawer 90 to or from the housing 3.

As shown in FIG. 2, a pair of cam followers 99, which protrude outward in the horizontal direction (on the near side and the far side of FIG. 2), is rotatably pivoted above the rear end sides of both the left and right side frames 92R and 92L. Both the left and right cam followers 99 have an axis center on the same line in the horizontal direction.

As shown in FIG. 3, a first guide face S1 and a second guide face S2 are formed in a step shape on each of the left and right side walls 3R of the frame member. The first guide face S1 and the second guide face S2 guide each of the cam followers 99 when the drawer 90 is mounted to or dismounted from the housing 3. The left and right side walls are positioned with the drawer 90 held therebetween in the left and right directions.

The first guide face S1 is shaped as a plane being oriented horizontally in the front and rear and left and right directions of the apparatus and the plain narrowly extends in the front and rear direction. The second guide face S2 is shaped as a plane oriented horizontally in the left and right direction (i.e. the height of the face S2 does not change in the left right direction) and inclined obliquely downward toward the rear side of the apparatus. The rear end of the first guide face S1 is continuously connected to the front end of the second guide face S2, and the first guide face S1 and the second guide face S2 together form a bent guide face. In addition, a stopper face S3 that is bent from the rear end of the second guide face S2 and rises upward is formed on the inner side wall 3R.

As shown in FIG. 1, in a state in which the drawer 90 is mounted to the frame member, both the cam followers 99 provided at the upper rear end sides of both the left and right frames 92R, 92L abut the stopper faces S3 of both the left and right side walls 3R. Protrusions (not shown) protruding inward (in directions opposite each other) are formed on the front end sides of both the left and right side wall 3R. Although this configuration is not shown, the front end portions of both the left and right side frames 92R, 92L of the drawer 90 are placed on the protrusions. Accordingly, the drawer 90 is supported by the frame member in a substantially horizontal state. In this state, at the positions where the photosensitive drums 71 are opposite the respective transfer rollers 73K to 73C, the photosensitive drums 71 make contact with the respective transfer rollers 73K to 73C with the conveyor belt 33 disposed therebetween.

Figure 4:
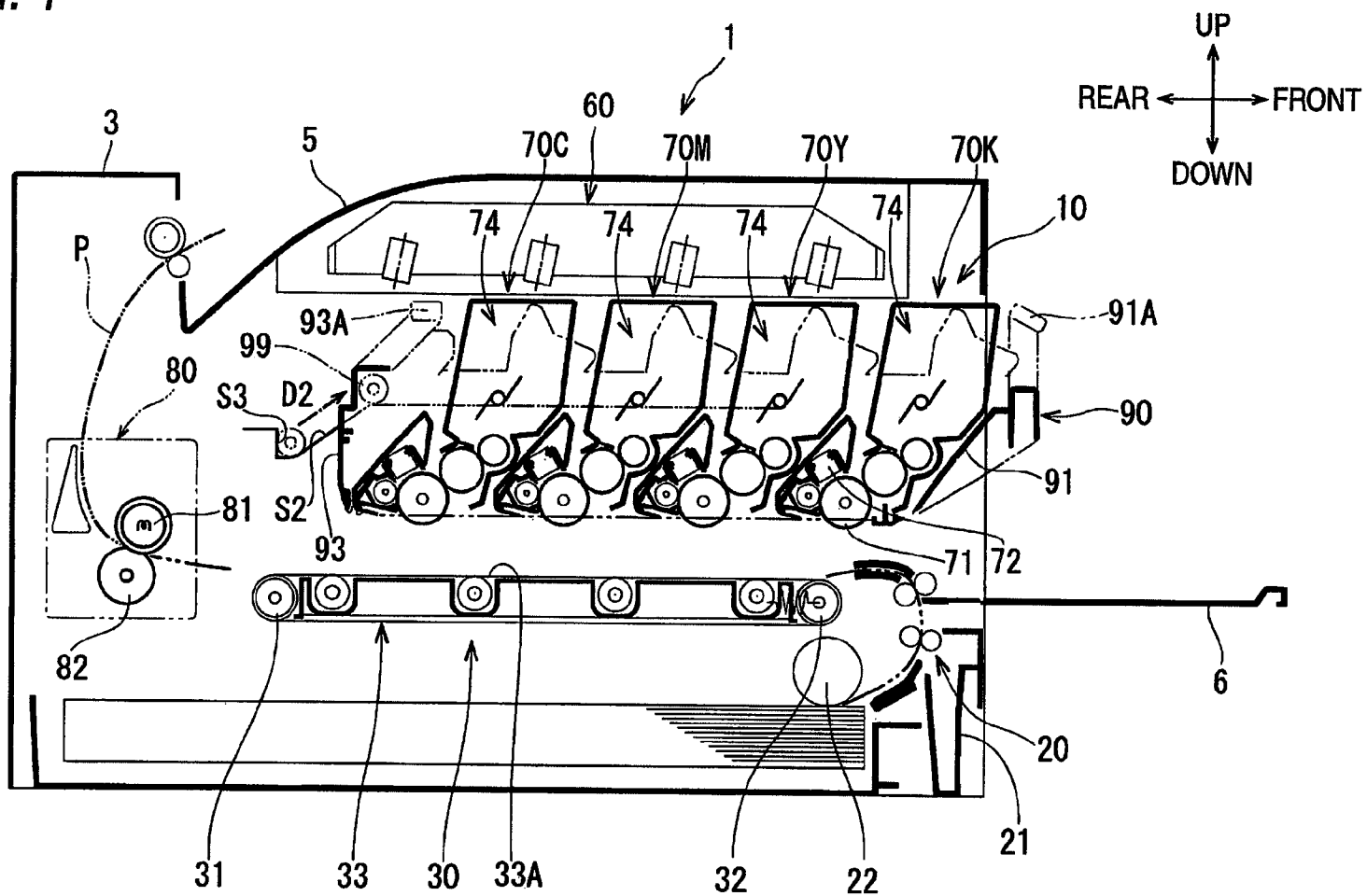
FIG. 4 is a schematic sectional view showing the operation of mounting/dismounting the drawer in which an image forming section is installed according to the image forming apparatus of the embodiment.
Figure 5:
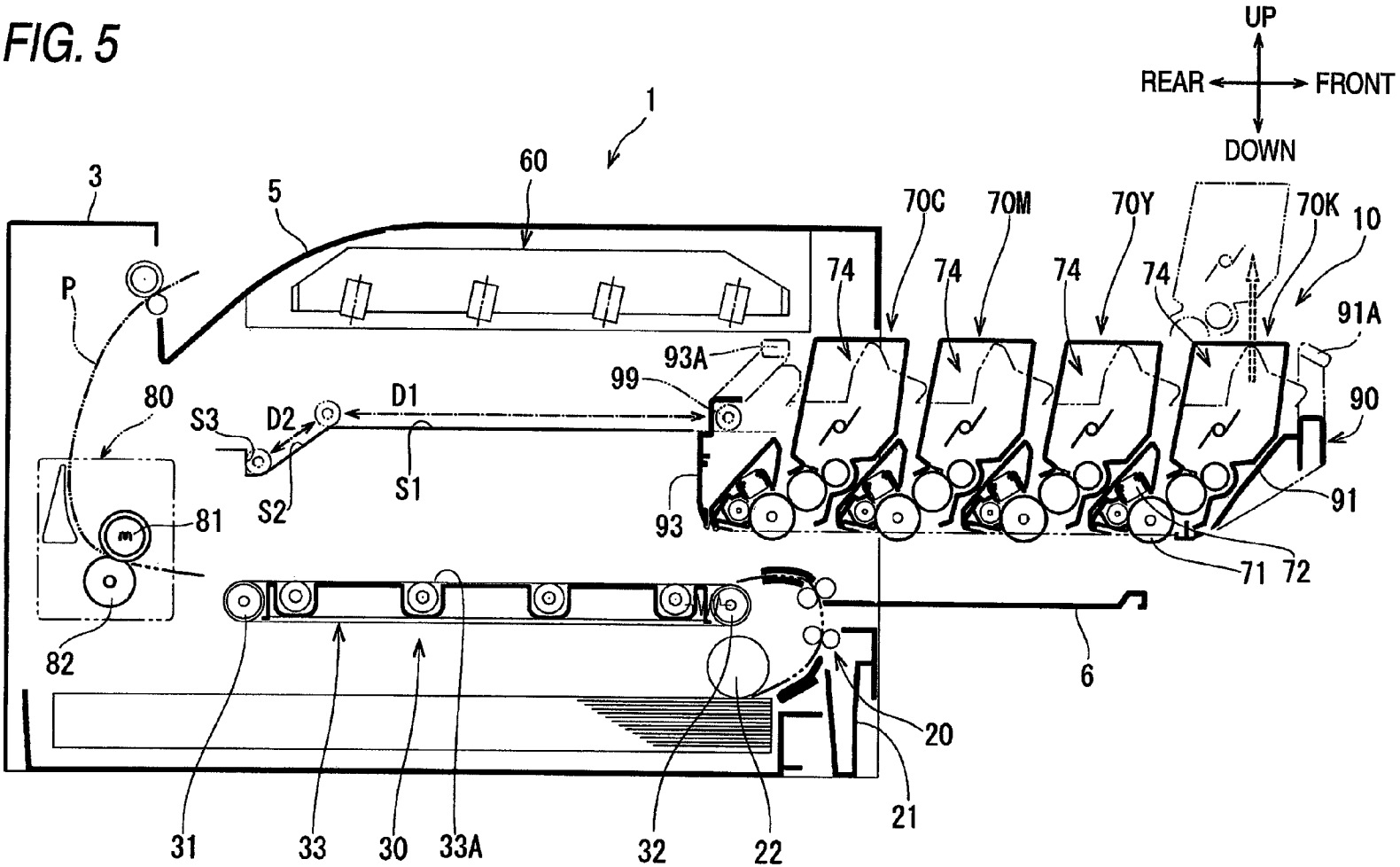
FIG. 5 is another schematic sectional view showing the operation of mounting/dismounting the drawer in which the image forming section is installed according to the image forming apparatus of the embodiment.

Furthermore, as shown in FIGS. 4 and 5, the drawer 90 is dismounted from the housing 3 as follows. First, as shown in FIG. 4, in a state in which the front cover 6 is open, the handle 91A disposed on the front end side of the drawer 90 is held and pulled toward the front side. Consequently, the cam followers 99 roll upward obliquely along the second guide faces S2. Hence, the drawer 90 is pulled out upward obliquely along a second direction D2 that is parallel to the inclined second guide faces S2. As a result, the photosensitive drums 71 are separated obliquely upward from the respective transfer rollers 73K to 73C.

When the drawer 90 is pulled further toward the front side, the cam followers 99 move from the second guide faces S2 to the first guide faces S1 and roll along the first guide faces 51 in the horizontal direction as shown in FIG. 5. Hence, the drawer 90 is pulled out in the horizontal direction along a first direction D1 that is parallel to the horizontal first guide faces S1. Then, in the state in which the drawer 90 is pulled out, the toner cartridges 74 can be dismounted from and mounted to the drawer 90. In addition, at the pulled-out position, the drawer 90 can be dismounted from the housing 3 by holding and lifting the handles 91A and 93A.

On the other hand, the drawer 90 is mounted to the housing 3 by reversing the dismounting operation. In other words, in the state in which the drawer 90 is dismounted from the housing 3, the cam followers 99 are placed on the first guide faces S1, and the drawer 90 is inserted into the housing 3. Consequently, the cam followers 99 roll in the horizontal direction along the first guide faces S1. Hence, the drawer 90 is inserted in the horizontal direction along the first direction D1.

When the drawer 90 is inserted further into the rear of the housing 3, the cam followers 99 move from the first guide faces S1 to the second guide faces S2 and roll obliquely downward along the second guide faces S2. As a result, the drawer 90 is inserted obliquely downward along the second direction D2 that is inclined from the horizontal direction. Thus, the cam followers 99 abut the stopper faces S3. At this time, the front end portions of both the left and right side frames 92R, 92L of the drawer 90 are placed on the above-mentioned protrusions protruded on the front end sides of both the left and right side walls 3R. Accordingly, the drawer 90 is supported by the frame member in a substantially horizontal state. As a result, the drawer 90 can be mounted to the frame member.

As described above, the maintenance of the process cartridges 70K to 70C provided in the drawer 90 and the replacement of the toner cartridges 74 provided in the drawer 90 can be carried out easily in the printer 1. The photosensitive drums 71, and the chargers 72, etc. are integrally supported and secured to the drawer 90 and are replaced as consumable components when the drawer 90 is replaced.

In the following description, the left and right direction (a direction along the rotational center of the rotating drum 71) is defined as a third direction that is three-dimensionally perpendicular to the first direction D1 and the second direction D2 (i.e. the left and right direction is perpendicular to both the first direction D1 and the second direction D2). In addition, the first guide face S1 is defined by a first plane oriented parallel to the first direction D1 and the third direction (the left and right direction). The second guide face S2 is defined by a second plane oriented parallel to the second direction D2 and the third direction (the left and right direction).

8. First Electrodes and Second Electrodes

In the state in which the drawer 90 is mounted to the frame member, electrical connections must be established between the electric circuits disposed inside the housing 3 and the drawer 90 in order to supply electric power to the respective components of the image forming section 10 installed in the drawer 90. Hence, in the printer 1, as shown in FIG. 3, the side wall 3R of the frame member is provided with a plurality of, e.g., 12, first electrodes 101, 102, 103, 104, 105, 106, 107, 108, 109, 110, 111 and 112. Furthermore, as shown in FIG. 2, the drawer 90 is provided with a plurality of, e.g. 12, second electrodes 201, 202, 203, 204, 205, 206, 207, 208, 209, 210, 211 and 212. Although other electrodes, such as electrodes connected to the ground, may also be provided between the side wall 3R of the frame member and the drawer 90, these electrodes are not described for the sake of simplicity.

8.1. Second Electrodes

As shown in FIG. 2, the second electrodes 201 to 212, which are each formed of a rectangular metal piece, are provided on the side face of the right side frame 92R of the drawer in an upper-lower two-tiered arrangement at predetermined intervals in the front and rear direction extending perpendicular to the third direction. In order to reduce the size of the drawer 90, the respective second electrodes 201 to 212 are substantially flush with the side face of the right side frame 92R (i.e. the second electrodes do not protrude much from the right side frame 92R). Inside the drawer 90, the second electrodes 201, 204, 207 and 210 are electrically connected to the respective corresponding development rollers 74C. The second electrodes 202, 205, 208 and 211 are electrically connected to the respective corresponding photosensitive drums 71. The second electrodes 203, 206, 209 and 212 are electrically connected to the respective corresponding chargers 72. In other words, the second electrodes are divided into four groups, 201 to 203, 204 to 206, 207 to 209 and 210 to 212, with each group corresponding to one of the four process cartridges 70K to 70C, respectively.

Figure 6:
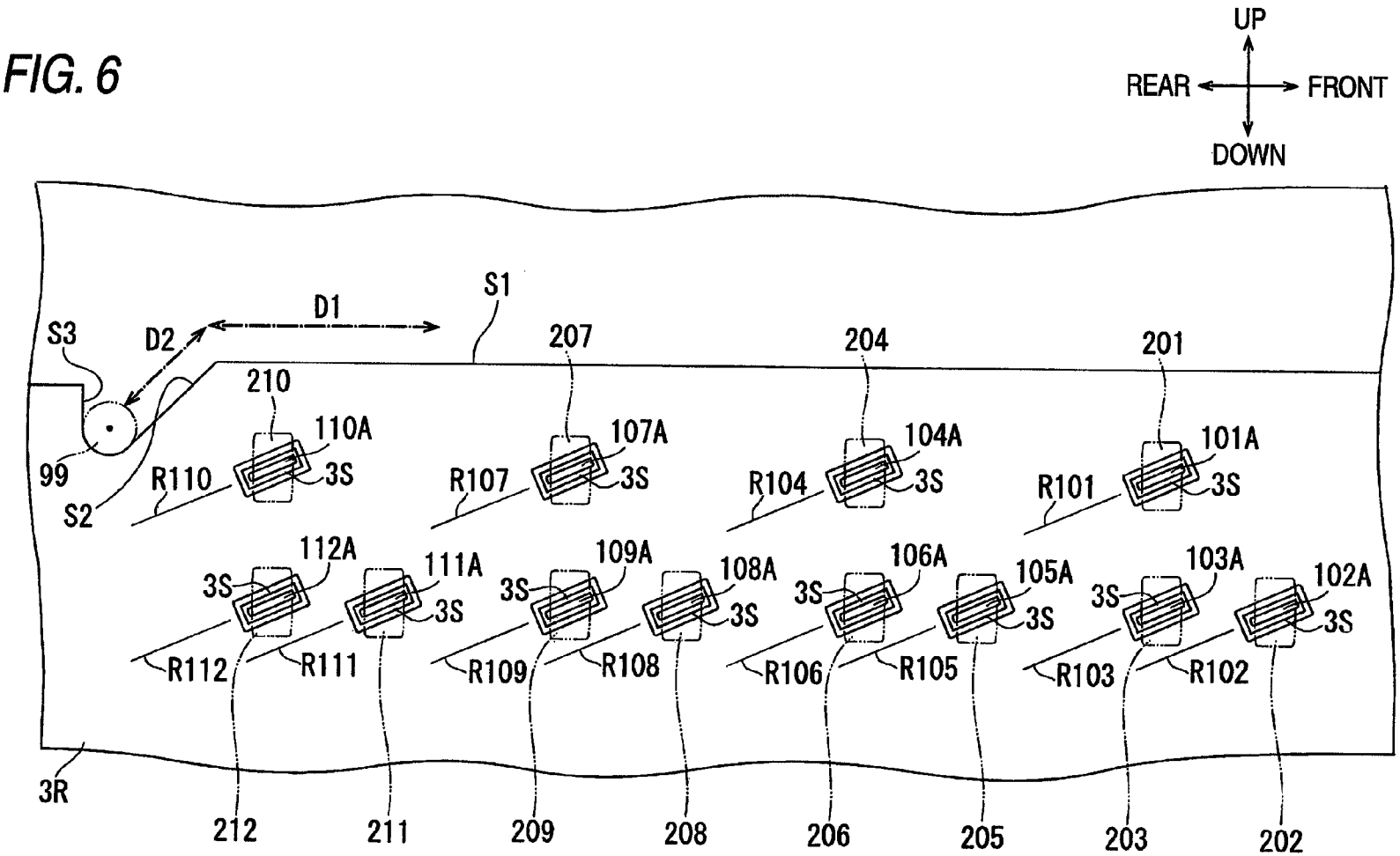
FIG. 6 is an explanatory view showing the positional relationship between the first electrodes of the frame member and the second electrodes of the drawer according to the image forming apparatus of the embodiment.

FIG. 6 is a view looking from the inner center of the housing 3 toward the side wall 3R, i.e. a view cross-sectioned along a section plane perpendicular to the third direction (the left and right direction). In FIG. 6, each two-dot chain line indicates a relative positional relationship between the side wall 3R and each of the second electrodes 201 to 212 in the state in which the drawer 90 is mounted to the frame member.

When the drawer 90 is dismounted from the frame member, the respective second electrodes 201 to 212 move along a locus which moves obliquely upward along the second direction D2 and then moves further in the horizontal direction along the first direction D1. Conversely, when the drawer 90 is mounted to the housing 3, the respective second electrodes 201 to 212 move along a locus, which moves in the horizontal direction along the first direction D1 and then moves further obliquely downward along the second direction D2.

8.2. First Electrodes

As shown in FIGS. 3 and 6, in the state in which the drawer 90 is mounted to the frame member, the first electrodes 101 to 112 are provided on the face of the side wall 3R, which is perpendicular to the third direction and disposed opposite the side face of the right side frame 92R having the second electrodes 201 to 212. Further, the first electrodes 101 to 112 are disposed opposite the second electrodes 201 to 212 of the right side frame 92R. Each of the respective first electrodes 101 to 112 is identical in configuration. Hence, only the first electrode 101 is described below, and the descriptions of the first electrodes 102 to 112 are omitted as necessary.

Figure 7:
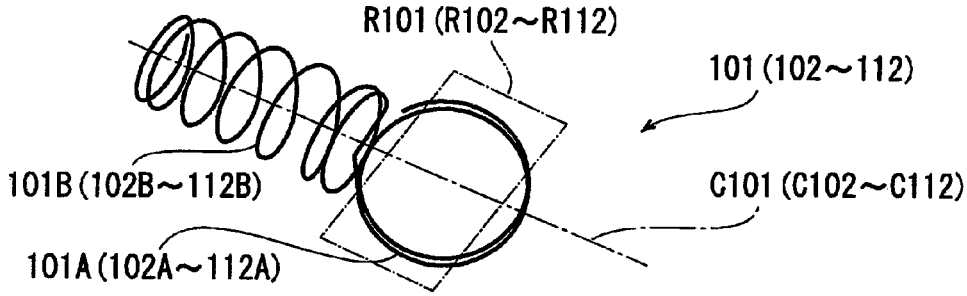
FIG. 7 is a perspective view showing the first electrode according to the image forming apparatus of the embodiment.

As shown in FIG. 7, the first electrode 101 has a contact portion 101A and a resilient portion 101B, formed by bending a metal wire. The contact portion 101A is formed into a ring-like shape along a intersection plane R101 by bending, and the resilient portion 101B is continuously connected to the contact portion 101A and formed into a coil spring shape by bending. The center axis line of the coil spring is parallel to the extended plane of the intersection plane R101.

The contact portion 101A is produced at low production cost by bending the wire extending from the end portion of the resilient portion 101B along the intersection plane R101 in order to form the wire into a ring-like shape having a diameter larger than that of the coil spring. The intersection plane R101 along which the contact portion 101A is formed is set in order to be parallel to the axis center C101 of the resilient portion 101B and includes the axis center C101.

Figure 8:
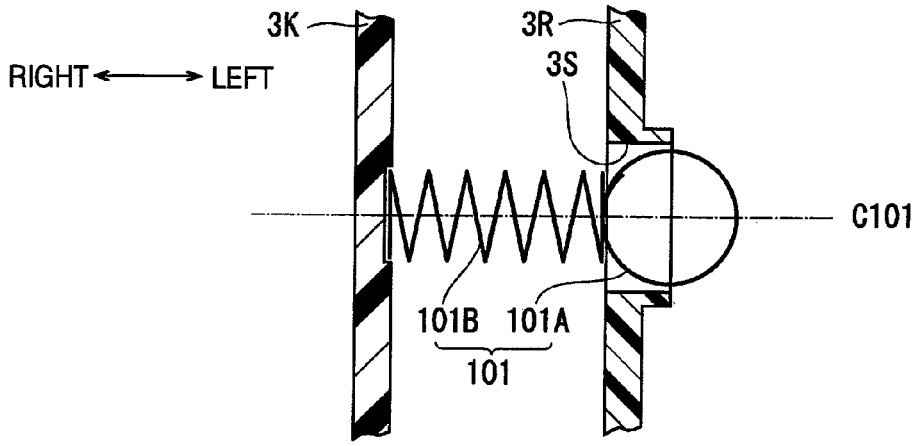
FIG. 8 is a magnified sectional view showing the main portions of the first electrode installed on the frame member according to the image forming apparatus of the embodiment.
Figure 9:
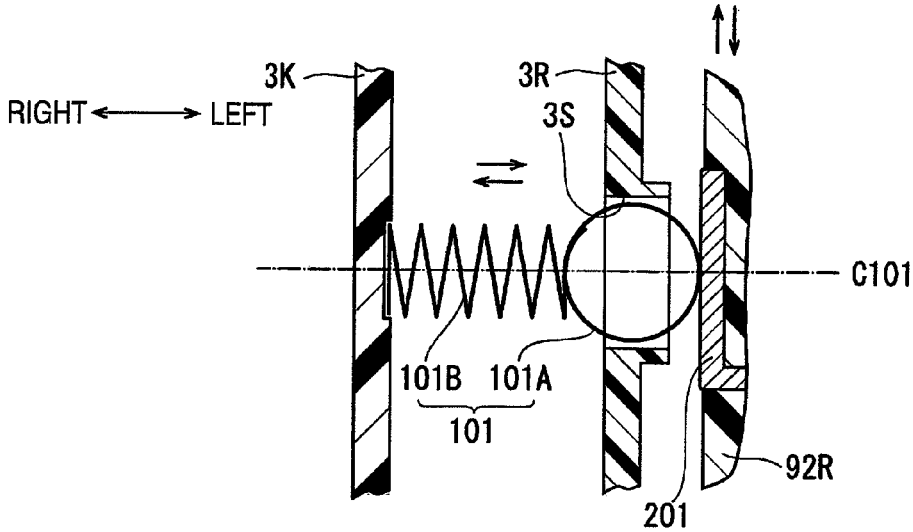
FIG. 9 is a magnified sectional view showing the main portions of the first electrode installed on the frame member and the second electrode of the drawer making contact with the first electrode according to the image forming apparatus of the embodiment.

As shown in FIG. 8, the first electrode 101 is disposed between a circuit board 3K having electric circuits, etc. and the side wall 3R, with the axis center C101 oriented in the third direction (the left and right direction) and the resilient portion 101B is compressed along the axis center C101. The contact portion 101A is inserted into a slit 3S formed in the side wall 3R, and part thereof protrudes from the slit 3S toward the right side frame 92R of the drawer 90. In other words, the intersection plane R101 of the contact portion 101A is parallel to the third direction (the left and right direction), and the part of the wire, which forms the contact portion 101A and is exposed from the side wall 3R to the drawer 90, extends in a direction substantially along the face of the side wall 3R on the side of the drawer 90 and protrudes from the face while being curved. In addition, the length of the slit 3S is larger than the outside diameter of the ring of the contact portion 101A. Further, the width of the slit 3S is larger than the thickness of the wire but is smaller than the coil diameter of the resilient portion 101B. Hence, as the resilient portion 101B is biased in the third direction (the left and right direction), the contact portion 101A can advance by virtue of the biasing action of the resilient portion 101B or can retract against the biasing action.

Figure 10:
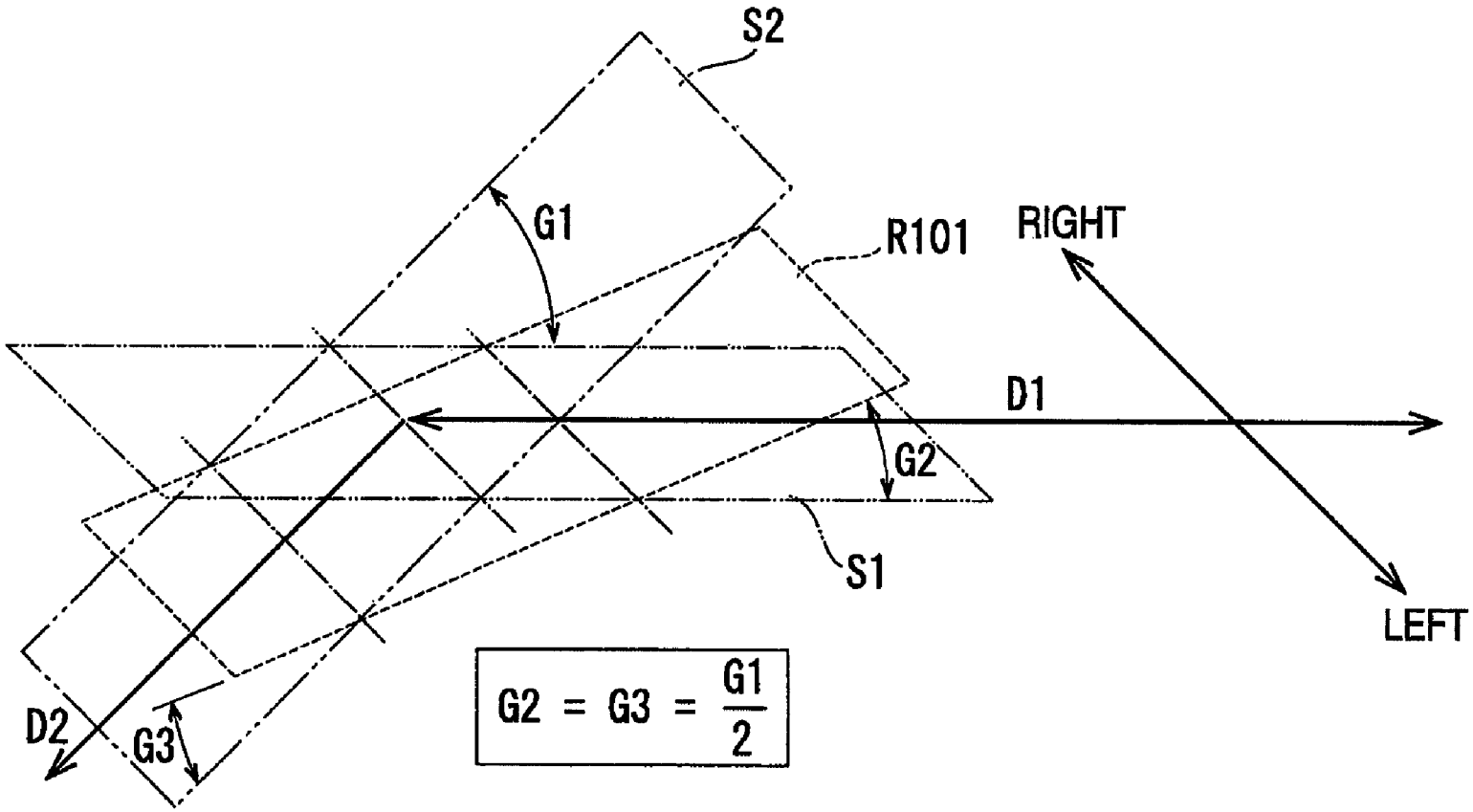
FIG. 10 is an explanatory view showing a first direction, a second direction, a third direction (left and right direction), a first plane, a second plane, and a intersection plane along a contact portion according to the image forming apparatus of the embodiment.

Furthermore, as shown in FIG. 10, in the first electrode 101, the direction of the contact portion 101A is set so that the intersection plane R101 of the contact portion 101A has a positional relationship with the first guide face S1 and the second guide face S2, such that the intersection plane R101 intersects the first guide face S1 and the second guide face S2 at angles G2, G3, respectively, which are each smaller than the acute intersection angle G1 formed by the intersection of the first guide face S1 and the second guide face S2. As described above, the first guide face S1 is parallel to the first direction D1 and the third direction (the left and right direction), and the second guide face S1 is parallel to the second direction D2 and the third direction (the left and right direction). In this case, the angles G2 and G3 are angles represented by "G2=G3=G1/2" with respect to the intersection angle G1. In other words, the direction of the contact portion 101A is set so that the intersection plane R101 of the contact portion 101A has a positional relationship in which the intersection plane R101 is oriented in an intermediate direction between the first and second directions D1 and D2. As shown in FIG. 10, the intersection angle G1 is also an acute intersection angle formed by the intersection of the first direction D1 and the second direction D2.

Like the first electrode 101, the first electrodes 102 to 112 are formed into the shape shown in FIG. 7. As shown in FIG. 8, part of each of the contact portions 102A to 112A thereof protrudes from the slit 3S toward the right side frame 92R of the drawer 90. Furthermore, as shown in FIG. 6, as in the case that the direction of the contact portion 101A is set in order to be parallel to the intersection plane R101, the directions of the contact portions 102A to 112A are set so as to be parallel to the intersection planes R102 to R112, respectively.

8.3. Contact States of the First and Second Electrodes at the Time of Mounting or Dismounting the Drawer Referring to FIGS. 6, 8 and 9, the contact states of the first electrode 101 and the second electrodes 201 at the time of mounting or dismounting the drawer 90 will be described below. Since the contact states of the first electrodes 102 to 112 and the second electrodes 202 to 212 are similar to the contact states of the first electrode 101 and the second electrodes 201, the descriptions thereof are omitted as necessary.

When the drawer 90 is inserted into the housing 3 along the first direction D1 and further inserted along the second direction D2, the right side frame 92R and the second electrodes 201 are moved along a locus similar to that of the drawer 90. At this time, the rear end portion of the right side frame 92R in the middle of movement contacts with the contact portion 101A on the side of the side wall 3R. Thus, the contact portion 101A is pressed toward the side wall 3R from the state shown in FIG. 8 and is displaced in a direction parallel to the third direction (the left and right direction) and in a direction of retracting from the right side frame 92R. In addition, during the movement of the drawer 90 to the mounting position thereof, the right side frame 92R is moved while the right side frame 92R and the second electrode 201 make friction contact with the contact portion 101A. As a result, at the position shown in FIG. 9 where the mounting of the drawer 90 is completed, the first electrode 101 makes contact with the second electrodes 201, thereby being electrically connected thereto.

Furthermore, when the drawer 90 is pulled out from the housing 3 along the second direction D2 and further pulled out along the first direction D1, the right side frame 92R and the second electrodes 201 are moved along a locus similar to that of the drawer 90. At this time, the right side frame 92R is moved while the right side frame 92R and the second electrodes 201 make friction contact with the contact portion 101A. When the right side frame 92R is moved away from the contact portion 101A, the contact portion 101A is displaced by the biasing force of the resilient portion 101B in a direction parallel to the third direction (the left and right direction) and in a direction toward the right side frame 92R, thereby returning to the original state thereof (see FIG. 8). As a result, the first electrode 101 is moved away from the second electrodes 201, thereby electrically disconnecting therefrom.

In the first electrode 101, the direction of the contact portion 101A is set so that the intersection plane R101 of the contact portion 101A has a positional relationship in which the intersection plane R101 is oriented in an intermediate direction between the first and second directions D1 and D2. Thus, when the drawer 90 is mounted or dismounted, the contact portion 101A makes friction contact with the second electrode 201 at a shallow angle (in a state in which the misalignment between the direction of the contact portion of one of the first electrode and the second electrode and the direction of the other of the first electrode and the second electrode is small). Consequently, among the contact states between the contact portion 101A and the right side frame 92R and between the contact portion 101A and the second electrode 201, the contact state in a direction of turning over the contact portion 101A (in a direction opposite the intersection plane R101 along the contact portion 101A) and the contact state in a direction of twisting the contact portion 101A are relieved. The contact states between the first electrodes 102 to 112 and the second electrodes 201 to 212 are similar to the contact states between the first electrode 101 and the second electrode 201.

9. Working Effect

In the printer 1 according to the embodiment, the first electrodes 101 to 112 are each formed of a metal wire bent into a shape along the intersection planes R101 to R112. For this reason, the production cost of the contact portion thereof can be reduced in comparison with that of the contact portion formed of the cup-shaped metal member according to the related technology.

In addition, in the printer 1, the directions of the contact portions 101A to 112A are set so that the intersection planes R101 to R112 of the contact portions 101A to 112A are parallel to the third direction (the left and right direction) and have a positional relationship in which the intersection planes R101 to R112 are intersected with the first guide face S1 and the second guide face S2 at angles G2 and G3 smaller than the acute intersection angle G1 formed by the intersection of the first guide face S1 and the second guide face S2. Again, the first guide face S1 is parallel to the first direction D1 and the third direction (the left and right direction), and the second guide face S2 parallel to the second direction D2 and the third direction (the left and right direction). In other words, the directions of the contact portions 101A to 112A are set so that the intersection planes R101 to R112 of the contact portions 101A to 112A have a positional relationship in which the intersection planes R101 to R112 are oriented in a direction in a range between the first and second directions D1, D2 (i.e. the direction of the locus of the second electrodes 201 to 212 at the time when the drawer 90 is mounted or dismounted). Thus, when the drawer 90 is mounted or dismounted, the contact portions 101A to 112A make friction contact with the right side frame 92R and the second electrodes 201 to 212 at a shallow angle. For this reason, with respect to the friction resistance generated between the contact portions 101A to 112A and the right side frame 92R and also generated between the contact portions 101A to 112A and the second electrodes 201 to 212, the friction resistance in a direction of turning over the contact portions 101A to 112A (in a direction opposite the intersection planes R101 to R112 of the contact portions 101A to 112A) and the friction resistance in a direction of twisting the contact portions 101A to 112A can be relieved. Thus, breaking of the contact portions 101A to 112A can be suppressed.

Consequently, in the printer 1 according to the exemplary embodiment, the electrical connection between the side wall 3R of the frame member and the drawer 90 can be established securely while reducing production cost. Ultimately, the electrical connection between the electric circuits inside the housing 3 and the drawer 90 can be established securely.

Furthermore, in the printer 1, the directions of the contact portions 101A to 112A are set so that the intersection planes R101 to R112 of the contact portions 101A to 112A have a positional relationship in which the intersection planes R101 to R112 are intersected with the first guide face S1 and the second guide face S2 at an angle (G2=G3=G1/2) half of the intersection angle G1. That is, the directions of the contact portions 101A have a positional relationship in which the intersection planes R101 to R112 are oriented in an intermediate direction between the first and second directions D1 and D2. For this reason, with respect to the friction resistances generated between the contact portions 101A to 112A and the right side frame 92R and also generated between the contact portions 101A to 112A and the second electrodes 201 to 212, the friction resistance in a direction of turning over the contact portions 101A to 112A and the friction resistance in a direction of twisting the contact portions 101A to 112A is further relieved. Thus, damaging of the contact portions 101A to 112A can be further suppressed. Specifically, since the directions of the contact portions 101A to 112A are set so that the intersection planes R101 to R112 have a positional relationship in which the intersection planes R101 to R112 are oriented in an intermediate direction between the first and second direction D1 and D2, the effects of the contact states between the contact portions 101A to 112A and the second electrodes 201 to 212 can be allocated almost evenly when the drawer 90 is inserted in the first direction D1 and in the second direction D2.

Moreover, in the printer 1, the first electrodes 101 to 112 have the resilient portions 101B to 112B formed of a metal wire. The resilient portions 101B to 112B are continuously connected to the contact portions 101A to 112A that bias the contact portions 101A to 112A against the second electrodes 201 to 212 in a direction parallel to the third direction (the left and right direction). Each of the resilient portions 101B to 112B is a coil spring. The contact portions 101A to 112A are each made by forming the wire of the end portion of the coil spring into a ring shape that is parallel to the direction of the center axis line of the coil spring. With this configuration, the first electrodes 101 to 112 having contact portions 101A to 112A and the resilient portions 101B to 112B can each be produced easily from a single wire. Hence, the production cost thereof can be reduced further.

Further, in the printer 1, since the first electrodes 101 to 112 having the contact portions 101A to 112A and the resilient portions 101B to 112B are provided on the frame member, the drawer 90 can be reduced in size in comparison with a case in which second electrodes having a configuration similar to that of the first electrodes are provided on the drawer 90. Since there is a possibility that the drawer 90 may be handled in a state of having been dismounted from the frame member, there is a high possibility that the exposed contact portions are damaged in the case that electrodes equipped with contact portions are adopted for the second electrodes 201 to 212 on the side of the drawer 90. However, since the contact portions are provided on the frame member, it is possible to reduce the risk of damaging the contact portions.

Still further, the printer 1 is equipped with the electrophotography-type image forming section 10, the drawer 90 and the conveying unit 30. The drawer 90 in which the image forming section 10 is installed is used as a replacement unit. The drawer 90 can be easily mounted to or dismounted from the frame member (the side wall 3R) by moving both the left and right side frames 92R, 92L in the first and second directions D1, D2. Furthermore, since the first electrodes 101 to 112 and the second electrodes 201 to 212 supply electric power to the development rollers 74C, the photosensitive drums 71 and the chargers 72 can be provided between the side frame 92R of the drawer 90 and the side wall 3R and the working effect of the present invention can be obtained securely.

In the exemplary embodiment, the directions of the contact portions 101A to 112A of all the first electrodes 101 to 112 are set as described above. However, it is possible that although the directions of the contact portions 101A etc of the first electrodes 101, etc. disposed on a side close to the upstream side of the first direction D1 (on the front side of the housing 3) are set to the above-mentioned direction, the directions of the contact portions 112A, etc of the first electrodes 112, etc. disposed on a side close to the downstream side of the second direction D2 (on the rear side of the housing 3) are set to have a positional relationship in which the directions are parallel to the second direction D2, for example. The range in which the contact portion 101A disposed on the side close to the upstream side of the first direction D1 makes contact with the right side frame 92R and the second electrodes 201 to 212 is longer than the range in which the contact portion 112A disposed on the side close to the downstream side of the second direction D2 makes contact therewith. Hence, the effect of not adjusting the directions of the contact portions is apt to be exerted to the contact portions disposed on the upstream side. Consequently, with the above-mentioned configuration, the working effect of the present invention can be obtained by making only a minor change.

Although the present invention has been described according to the above exemplary embodiment, the present invention is not limited to the above-mentioned embodiment but can be modified and applied appropriately without departing from the spirit and scope of the present invention.

The expression "the intersection planes R101 to R112 of the contact portions 101A to 112A have a positional relationship in which the intersection planes R101 to R112 are intersected with the first guide face S1 and the second guide face S2 at an angle (G2=G3=G1/2) half of the intersection angle G1, means that such a relationship should only be obtained substantially. There is some margin for dimensional errors, assembling accuracy, etc. of components.

Components other than the drawer 90, such as the conveying unit 30, the fixing unit 80 and a waste toner collection unit, may also be used as replacement units, provided that such components are mounted and dismounted similarly as the drawer 90.

In addition, the shape of the contact portion is not limited to the ring shape described in the above-mentioned embodiment but may be other shapes, for example, an elliptical or rectangular ring shape or a shape formed substantially along a intersection plane, preferably a shape extending long substantially along the face of a member on which the contact portion is disposed.

Furthermore, the coil spring serving as the resilient portion can be omitted by adopting a configuration in which the resilience of the contact portion itself is used to make contact with the other electrode.

Moreover, the section for supporting the drawer 90, the section for supporting the conveying unit 30, the section for supporting the first electrodes, etc. of the frame member may be formed of separate members, and these members may be combined into the frame member.

What is claimed:

1. An image forming apparatus comprising:

a frame member including a first electrode;

a replacement unit including a second electrode that electrically contacts the first electrode, wherein the replacement unit is movable relative to the frame member along a moving direction, the moving direction includes a first direction and a second direction that intersects the first direction, wherein the first electrode is formed by a wire and includes a contact portion that contacts the second electrode, wherein the contact portion, which is bent along an intersection plane, is movable in a third direction that is perpendicular to a plane including both of the first direction and the second direction, and wherein a direction of the contact portion is set so that the intersection plane of the contact portion intersects with a first plane and a second plane at angles smaller than an intersection angle formed by an intersection of the first plane and the second plane, and, wherein the first plane is parallel to both the first direction and the third direction, and the second plane is parallel to both the second direction and the third direction, and wherein the intersection angle between the first plane and the second plane is an acute angle.

2. The image forming apparatus according to claim 1, wherein the direction of the contact portion is set so that the intersection plane along the contact portion intersects with the first plane and the second plane at an angle equal to half the intersection angle between the first plane and the second plane.

3. The image forming apparatus according to claim 1, wherein the first electrode and the second electrode are each respectively provided on a side face of the frame member and the replacement unit, the side faces being perpendicular to the third direction and opposing each other, wherein the contact portion protrudes from the side face of the frame member toward the side face of the replacement unit, and a protruded portion of the contact portion extends along a direction of the side face.

4. The image forming apparatus according to claim 1, wherein the wire includes a resilient portion, which is formed by bending the wire continuously, and which is connected to the contact portion, and wherein the resilient portion biases the contact portion against the other of the first electrode and the second electrode in a direction parallel to the third direction, wherein the resilient portion is a coil spring, and the contact portion is formed into a ring shape by bending the wire of the end portion of the coil spring in a direction parallel to the center axis line of the coil spring.

5. The image forming apparatus according to claim 1, wherein the first electrode includes the contact portion and the resilient portion.

6. The image forming apparatus according to claim 1, further comprising:

an image forming section provided in the frame member, wherein the image forming section forms toner images on the surfaces of recording media;

a drawer including a left side frame and a right side frame, wherein the left and right side frames support the image forming section on both sides in the width direction of the image forming section, and a conveying unit provided in the frame member, the conveying unit including a conveyor belt, which contacts with the back sides of the recording media to convey the recording media, and transfer rollers, which transfer the toner images to the recording media, wherein the replacement unit comprises the drawer, the image forming section disposed in the drawer, and the left and right side frames supported movably by the frame member in the first direction and the second direction, and wherein the second electrode is provided on one of the left and the right side frame and the first electrode is provided on an opposing side face of the frame member.

7. The image forming apparatus according to claim 6, wherein the image forming section is a tandem type image forming section in which a plurality of toner cartridges, each corresponding to one of a plurality of colors are arranged in series along the conveying direction of the recording media, wherein the drawer includes a plurality of the second electrodes provided on the right and left side frames along the longitudinal direction thereof, and the frame member includes a plurality of the first electrodes provided at positions corresponding to the positions of the plurality of second electrodes.

8. The image forming apparatus according to claim 7, wherein the first electrode includes the contact portion, and wherein the direction of the contact portions of at least one of a plurality of the first electrodes, which is provided on a upstream side of the first direction, is set so that the intersection plane along the contact portion intersects with the first plane and the second plane at angles smaller than the intersection angle between the first plane and the second plane.

9. An image forming apparatus comprising:

a frame member;

a replacement unit, which is movable relative to the frame member;

a first electrode provided on a side face of the frame member, the side face of the frame member being perpendicular to a third direction that is perpendicular to a plane including a first direction and a second direction; and a second electrode, contacting the first electrode, provided on a side face of the replacement unit, the side face of the replacement unit being perpendicular to the third direction and opposing the side face of the frame member, wherein the first electrode is formed by a wire and has a portion that protrudes from the side face of the frame member, and wherein a protruding portion of the wire extends along a direction of the side face, and a direction of the protruding portion of the wire intersects with the first direction and the second direction at angles smaller than an acute intersection angle formed between the intersection of the first direction and the second direction.

10. The image forming apparatus according to claim 9, wherein the wire is bent to form a contact portion formed from at least part of a ring-like shape extending along a plane which is perpendicular to the side face, and wherein a part of the contact portion protrudes from the side face and extends along the direction of the side face.

11. The image forming apparatus according to claim 9, wherein the wire includes a resilient portion, which is formed by bending the wire continuously, and which is connected to the contact portion, and wherein the resilient portion biases the contact portion against the other of the first electrode and the second electrode in a direction parallel to the third direction, wherein the resilient portion is a coil spring, and the contact portion is formed into a ring shape by bending the wire of the end portion of the coil spring in a direction parallel to the center axis line of the coil spring.

12. The image forming apparatus according to claim 9, wherein the first electrode includes the contact portion and the resilient portion.

13. The image forming apparatus according to claim 9, further comprising:

an image forming section provided in the frame member, wherein the image forming section forms toner images on the surfaces of recording media;

a drawer including a left side frame and a right side frame, wherein the left and right side frames support the image forming section on both sides in the width direction of the image forming section, and a conveying unit provided in the frame member, the conveying unit including a conveyor belt, which contacts with the back sides of the recording media to convey the recording media, and transfer rollers, which transfer the toner images to the recording media, wherein the replacement unit comprises the drawer, the image forming section disposed in the drawer, and the left and right side frames supported movably by the frame member in the first direction and the second direction, and wherein the second electrode is provided on one of the left and the right side frame and the first electrode is provided on an opposing side face of the frame member.

14. The image forming apparatus according to claim 13, wherein the image forming section is a tandem type image forming section in which a plurality of toner cartridges, each corresponding to one of a plurality of colors are arranged in series along the conveying direction of the recording media, wherein the drawer includes a plurality of the second electrodes provided on the right and left side frames along the longitudinal direction thereof, and the frame member includes a plurality of the first electrodes provided at positions corresponding to the positions of the plurality of second electrodes.

15. The image forming apparatus according to claim 14, wherein the first electrode includes the contact portion, and wherein the direction of the contact portions of at least one of a plurality of the first electrodes, which is provided on a upstream side of the first direction, is set so that the intersection plane along the contact portion intersects with the first plane and the second plane at angles smaller than the intersection angle between the first plane and the second plane.

* * * * *